US008672329B2

(12) United States Patent
Wang et al.

(10) Patent No.: US 8,672,329 B2
(45) Date of Patent: Mar. 18, 2014

(54) LIFT MECHANISM OF TILE-BASED GAME MACHINE

(75) Inventors: Hu Wang, Shaoxing (CN); Guo-Xin Wu, Shaoxing (CN)

(73) Assignee: Shaoxing City Kewei Electron & Techology Co., Ltd., Shaoxing, Zhejiang Province (CN)

( * ) Notice: Subject to any disclaimer, the term of this patent is extended or adjusted under 35 U.S.C. 154(b) by 0 days.

(21) Appl. No.: 13/528,820

(22) Filed: Jun. 20, 2012

(65) Prior Publication Data

US 2012/0326388 A1 Dec. 27, 2012

(30) Foreign Application Priority Data

Jun. 24, 2011 (CN) ..... 2011 1 0172307

(51) Int. Cl.
*A63F 1/12* (2006.01)
*A63F 9/20* (2006.01)

(52) U.S. Cl.
USPC ..... 273/309; 273/144 A; 273/149 R

(58) Field of Classification Search
USPC ..... 273/309, 144 A, 149 R
See application file for complete search history.

(56) References Cited

U.S. PATENT DOCUMENTS

| | | | | |
|---|---|---|---|---|
| 3,899,178 | A * | 8/1975 | Watanabe | 273/309 |
| 4,219,200 | A * | 8/1980 | Takahashi | 273/309 |
| 4,264,074 | A * | 4/1981 | Sobajima | 273/149 R |
| 4,534,561 | A * | 8/1985 | Okuno et al. | 273/149 R |
| 6,113,100 | A * | 9/2000 | Mu | 273/149 R |
| 6,626,435 | B1 * | 9/2003 | Kanamori | 273/309 |

* cited by examiner

*Primary Examiner* — Benjamin Layno

(57) ABSTRACT

A lift mechanism of a tile-based game machine is installed on a table. The lift mechanism includes a lift plate. One end of the lift plate is coupled to the table, and another end of the lift plate is a movable end. The movable end of the lift plate is provided with a door, and the door is provided with a restoring spring. A lift bracket is provided under the lift plate. A crank is provided under the lift bracket to cooperate with the lift bracket. An electric motor is connected with the crank. The present invention has a simple configuration and the tiles can be ascended quickly and the failure rate is low.

10 Claims, 8 Drawing Sheets

LIFT MECHANISM OF TILE-BASED GAME MACHINE

BACKGROUND OF THE INVENTION

1. Field of the Invention

The present invention relates to a lift mechanism of a tile-based game machine.

2. Description of the Prior Art

Tile-based game machines, such as Domino machines, Okey machines, are popular entertainments in Europe and Latin America. In the past, the tiles are shuffled manually. This way has some drawbacks. Accordingly, the inventor of the present invention developed an automatic Domino machine as disclosed in Chinese Patent No. ZL200810062993.X. The Domino machine comprises a card table with a tabletop. The middle of the card table is provided with a shuffle device having a conveying groove. The shuffle device has tile passages around the shuffle device to communicate with the conveying groove. Four push and lift devices are provided above the tile passages. Stack devices are provided between the conveying groove and the tile passages. This patent achieves automation to shuffle and deal the tiles to overcome the aforesaid drawbacks.

However, the lift mechanism has the following drawbacks. The structure is complicated. The structures of the lift plate and the crank are complicated and cannot be maintained easily. The tiles are always jammed because of foreign articles or slight vibration of the tiles or displacement of the lift mechanism.

Accordingly, the present invention intends to provide a lift mechanism for a tile-based game machine for improving the shortcomings mentioned above.

SUMMARY OF THE INVENTION

The primary object of the present invention is to provide a lift mechanism of a tile-based game machine to push the tiles in an oblique way. The present invention has a simple configuration and low cost, and the tiles can be ascended quickly and won't be jammed, and the failure rate is low.

In order to achieve the aforesaid object, the lift mechanism is installed on a table. The lift mechanism comprises a lift plate. One end of the lift plate is coupled to the table, and another end of the lift plate is a movable end. A lift bracket is provided under the lift plate. A crank is provided under the lift bracket to cooperate with the lift bracket. An electric motor is connected with the crank.

Preferably, one end of the crank is connected with the electric motor and another end of the crank is a movable end. The movable end of the crank is provided with a bearing. The lift bracket has a hook extending from a left side thereof to cooperate with the bearing.

Preferably, the crank is provided with an induction magnet and a lift control plate corresponds in position to the crank. The lift control plate is provided with an upper sensor and a lower sensor corresponding in position to the induction magnet of the crank when the lift plate is ascended and descended.

Preferably, the movable end of the lift plate is provided with a door and the door is provided with a restoring spring.

Preferably, the lift mechanism further comprises a push member. The push member has a contact surface at a certain angle. The contact surface of the push member is contact with tiles and perpendicular to the lift plate when the lift plate is is descended to the lowest and the push member pushes the tiles to the lift plate. Thus, the tiles on the lift plate are ascended to the tabletop and arranged in order.

Preferably, the lift mechanism further comprises a lid disposed at an upper end of the push member. The lid has a bottom surface. The tiles have a thickness. A distance defined between the bottom surface of the lid and the tiles is smaller than the thickness of the tiles. Alternatively, the lid is disposed at an upper end of a tile passage. The distance between the bottom surface of the lid and the tiles is smaller than the thickness of the tiles. This ensures the topmost tile won't move upward when the tiles are pushed.

Preferably, the distance between the bottom surface of the lid and the tiles is from 1 mm to 2 mm, which is beneficial to achieve the aforesaid object.

The present invention uses an oblique way to push the tiles instead of the conventional transverse way to push the tiles and/or the way to ascend/descend the tiles. The present invention has the following advantages. Because the front end of the lift plate is fixed, the tiles are obliquely pushed from the bottom to the top and won't be jammed due to foreign articles or slight vibration of the tiles or displacement of the lift mechanism. One end of the lift plate is fixed to the tabletop, which is beneficial for a seamless connection of the lift plate and the tabletop to ensure a tidy machine and to play games conveniently. The lift plate is driven by the crank, which can be operated stably and conveniently and has a simple configuration.

DETAILED DESCRIPTION OF THE PREFERRED EMBODIMENTS

Embodiments of the present invention will now be described, by way of example only, with reference to the accompanying drawings.

Figure 1:
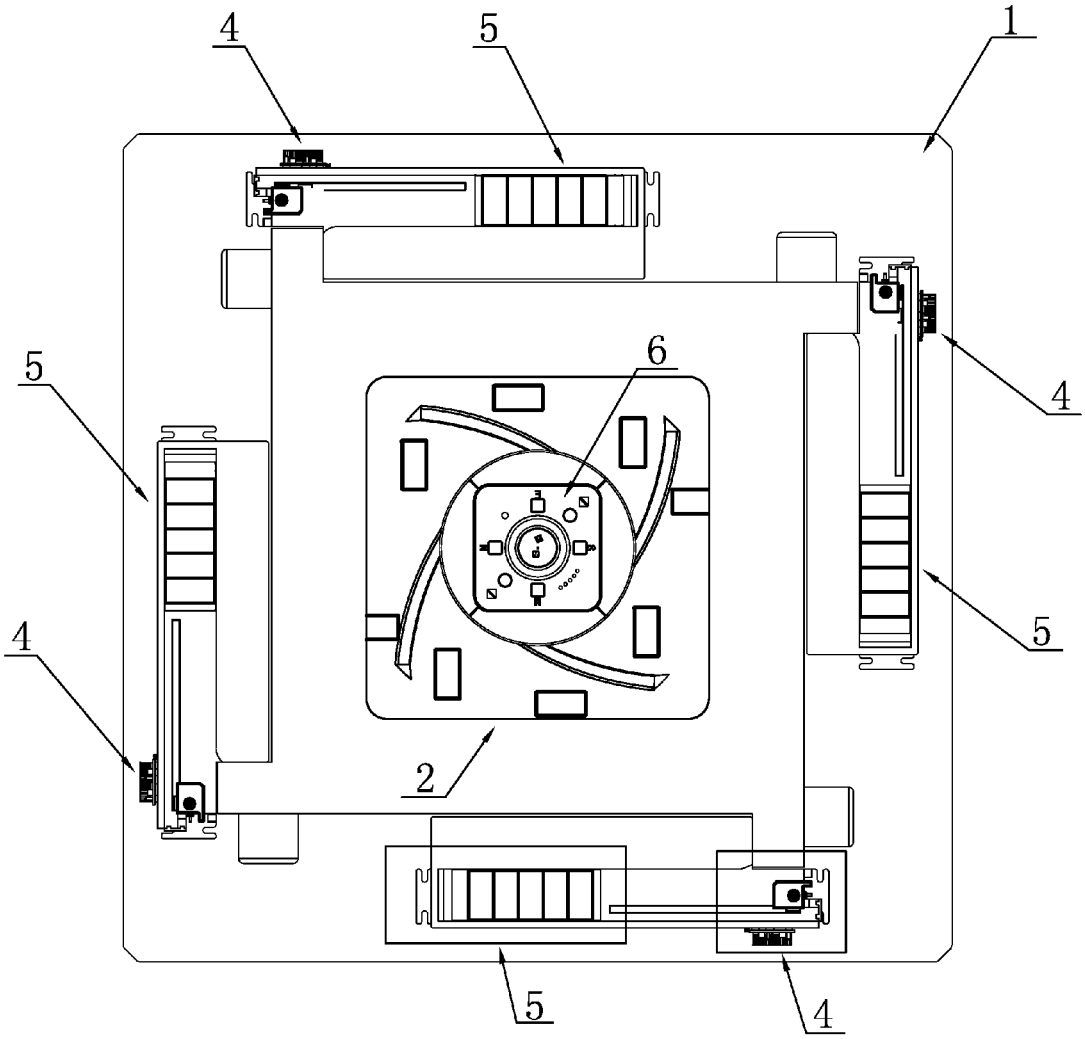
FIG. 1 is a top view of the present invention.
Figure 2:
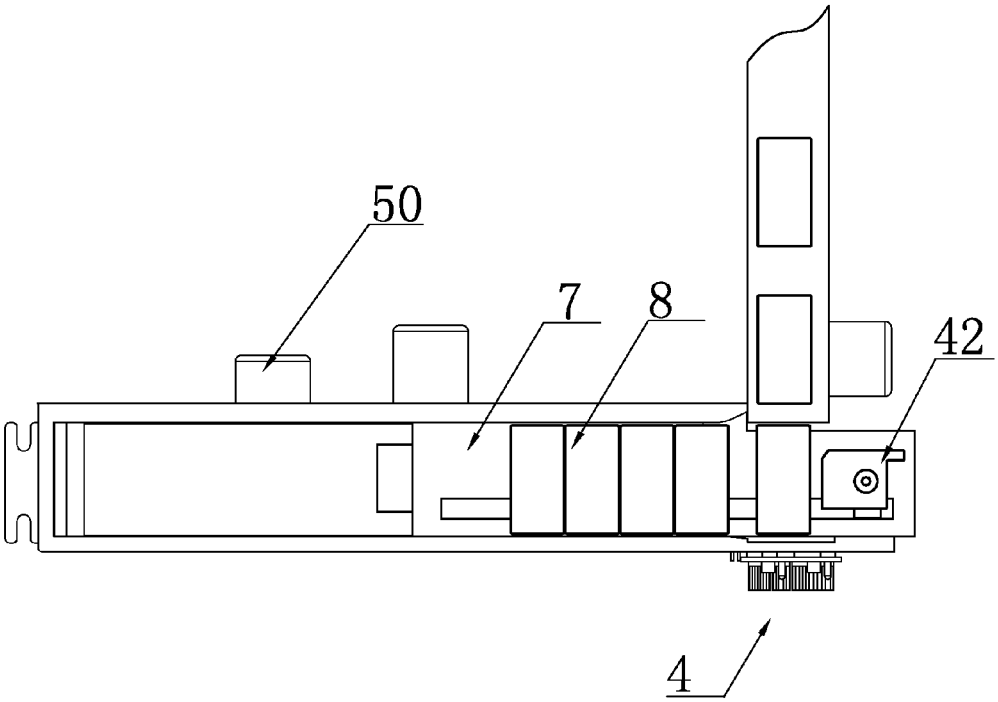
FIG. 2 is a schematic view showing the stack mechanism to push the tiles toward the lift mechanism.

As shown in FIG. 1, the tile-based game machine comprises a table 1. The table 1 is provided with a shuffle mechanism 2, four conveying mechanisms 3, four stack mechanisms 4, four lift mechanisms 5, and a central lift mechanism 6. The four conveying mechanisms 3, the four stack mechanisms 4 and the four lift mechanisms 5 are disposed on four sides of the table 1. The central lift mechanism 6 is disposed at the center of the table 1. The central lift mechanism 6 is provided with operation buttons to shuffle and lift tiles. The present invention is not limited to this tile-based game machine, which can be applied to the pending application filed by the applicant in 2008 and can be used to other tile-based game machines.

As shown in FIG. 2 to FIG. 5, the lift mechanism 5 comprises a lift plate 54. The lift plate 54 communicates with a support seat 40 of the stack mechanism 4 though a tile passage 7. The tiles 8 are pushed by a push member 42 through the tile passage 7 to the lift plate 54. One end of the lift plate 54 is coupled to the table 1 through a hinge 55. The lift board 54 can be turned about the hinge 55. Another end of the lift plate 54 is a movable end. The movable end of the lift plate 54 is provided with a door 511. The door 511 is provided with a restoring spring 510. A lift bracket 53 is provided under the lift plate 54. A crank 51 is provided under the lift bracket 53 to cooperate with the lift bracket 53. An electric motor 50 is connected with the crank 51.

Preferably, one end of the crank 51 is connected with the electric motor 50 and another end of the crank 51 is a movable end. The movable end of the crank 51 is provided with a bearing 52. The lift bracket 53 has a hook extending from a left side thereof to cooperate with the bearing 52. Through turning of the crank 51, when the bearing 52 is pushed to the lower end of the hook at the left side of the lift bracket 53, the lift bracket 53 will descend by the push of the crank 51. The end facing the tile passage 7 of the lift board 54 is driven by the lift bracket 53 to descend for the tiles to be pushed forward. When the tiles 8 are completely pushed to the lift board 54, the crank 51 continues to turn from the hook to the flat end. Thus, the lift bracket 53 drives the lift plate 54 to complete ascending.

The crank 51 is provided with an induction magnet 56, and a lift control plate 59 corresponds in position to the crank 51. The lift control plate 59 is provided with upper and lower sensors 57 corresponding in position to the induction magnet 56 of the crank 51 when the lift plate 54 is ascended and descended.

Figure 3:
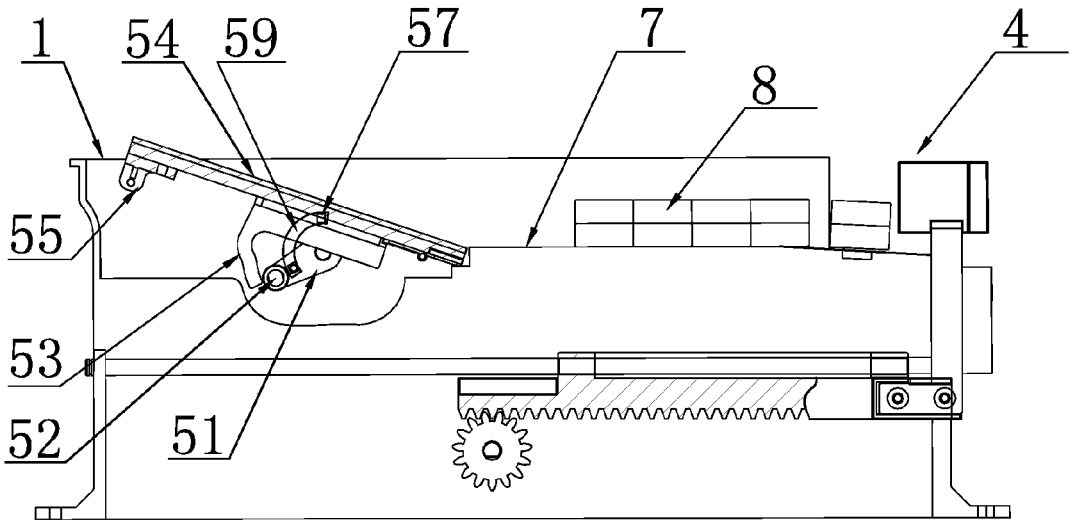
FIG. 3 is a schematic view of the present invention in a first operating state.
Figure 4:
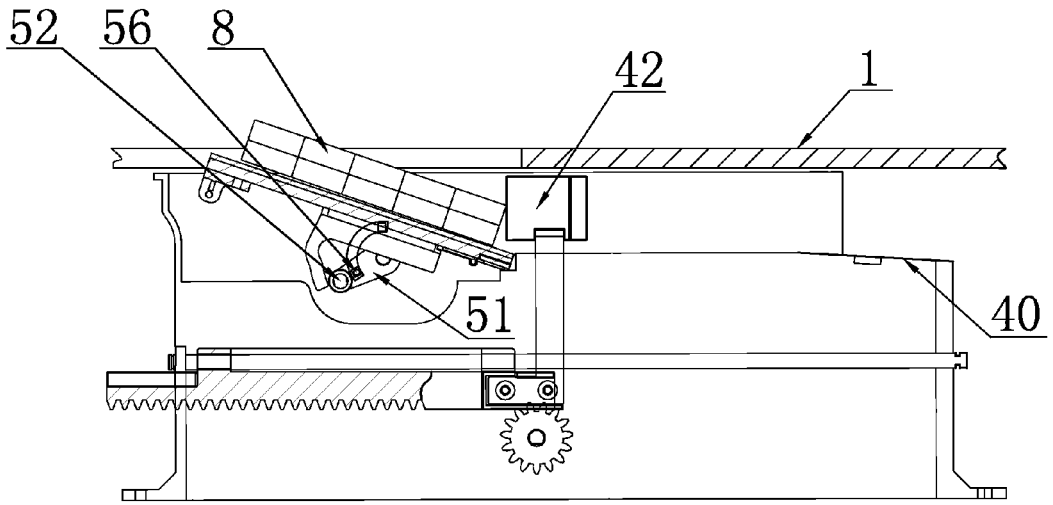
FIG. 4 is a schematic view of the present invention in a second operating state.
Figure 5:
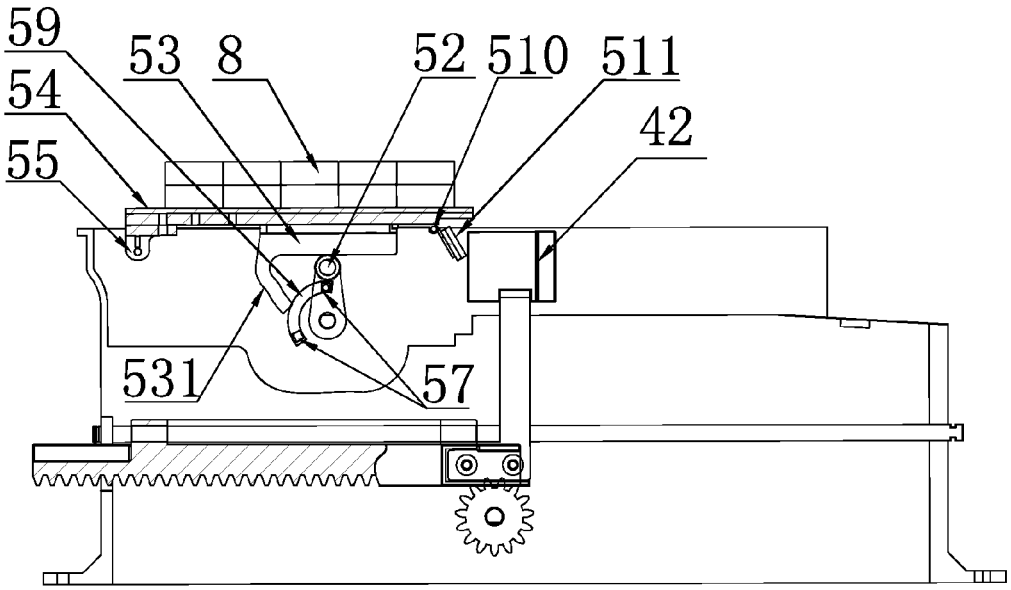
FIG. 5 is a schematic view of the present invention in a third operating state.

To practice the present invention, after the tiles are shuffled, the tiles 8 are stacked and ascended to the tabletop. The user operates the operation button of the central lift mechanism 6 to drive the electric motor 50 to bring the crank 51. The crank 51 is provided with the bearing 52. Through the turning of the crank 51, the bearing 52 is moved to the lower end of the hook at the left side of the lift bracket 53 and the other end of the lift plate 54 activated by the crank 51 is descended to the lowest to be inclined, as shown in FIG. 3. The lowest end of the lift plate 54 is flush with the tile passage 7. The crank 51 is provided with the induction magnet 56, and the lift control plate 59 corresponds in position to the crank 51. The lift control plate 59 is provided with the upper and lower sensors 57 corresponding in position to the induction magnet 56 of the crank 51 when the lift plate 54 is ascended and descended. When the lift plate 54 is fully descended, the induction magnet 56 on the crank 51 will be turned to the lower sensor 57 of the lift control plate 59. The sensor 57 will send a signal to stop the electric motor 50. The stack mechanism 4 runs to push the tiles 8 in the tile passage 7 to the lift plate 54 until all the tiles 8 are over the lowest end of the lift plate 54 as shown in FIG. 4. This can prevent the tiles from holding against the edge of the tabletop when the lift plate 54 is ascended. At the moment, the electric motor 50 drives the bearing 52 of the crank 51 to the other end of the lift bracket 53 so as to raise the lift plate 54 and the tiles 8. When the lift plate 54 and the tiles 8 are ascended to be flush with the tabletop, the crank 51 will be turned to the upper sensor 57 and the upper sensor 57 will send a signal to stop the electric motor 50. During ascending, the door 511 having the restoring spring 511 of the lift plate 54 will automatically turn downward. After ascending, the door 511 will automatically turn upward and the stack mechanism 4 will retract for next tile stack and lift, as shown in FIG. 5.

Figure 6:
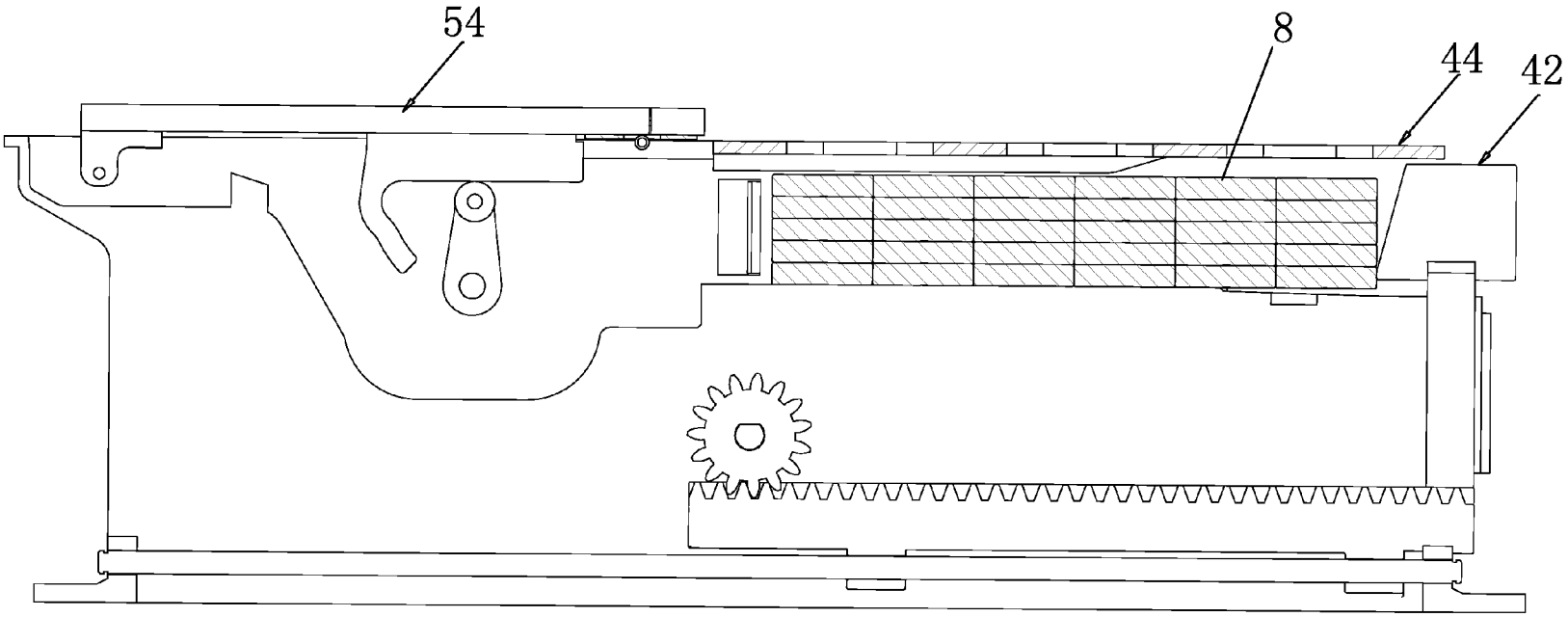
FIG. 6 is a sectional view showing the oblique push member and the lid.
Figure 7:
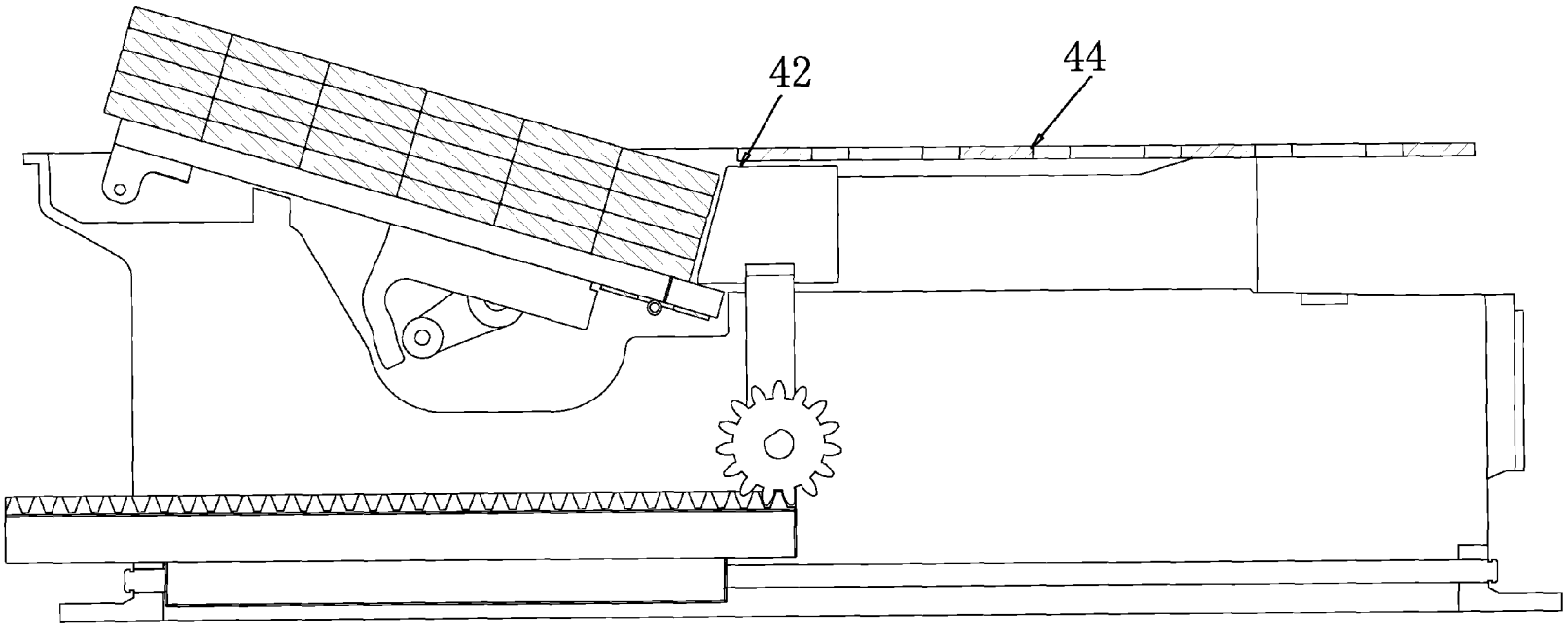
FIGS. 7 and 8 are schematic views showing the oblique push member and the lid when in use.
Figure 8:
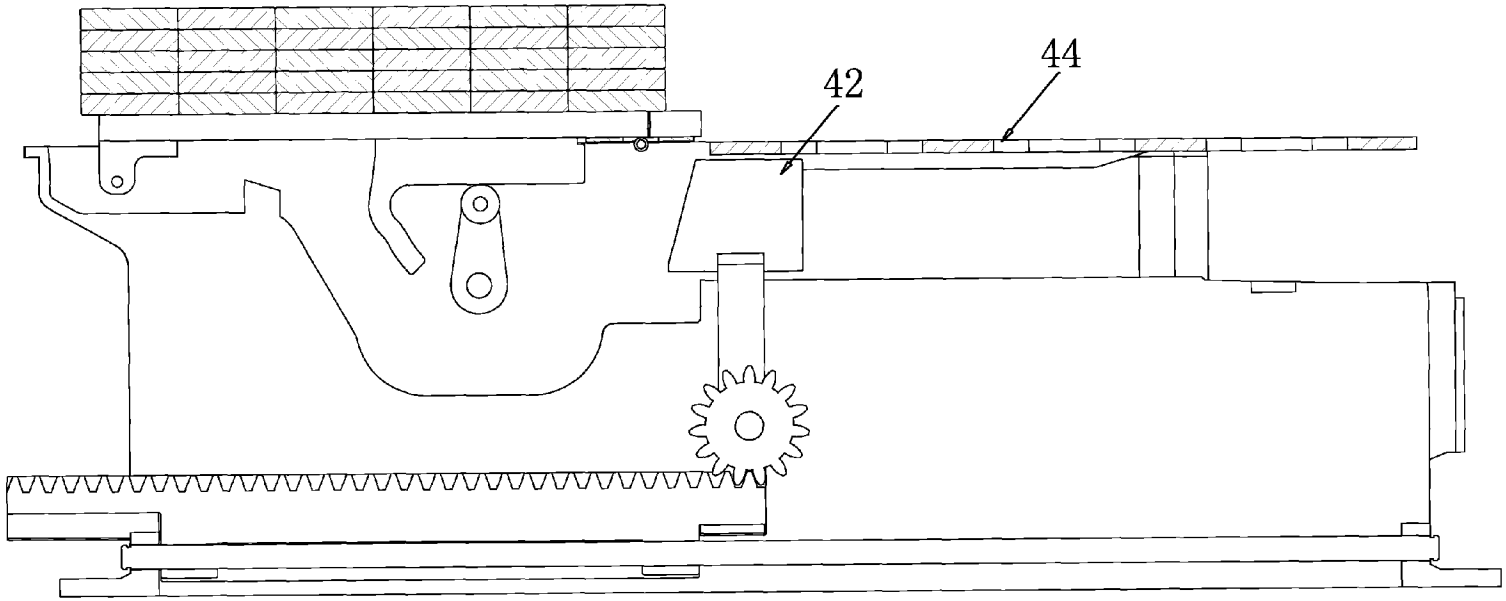

Preferably, as shown in FIG. 6, FIG. 7 and FIG. 8, the push member 42 has a contact surface at a certain angle. When the lift plate 54 is descended to the lowest and the push member 42 pushes the tiles 8 to the lift plate 54, the contact surface of the push member 42 is contact with the tiles 8 and perpendicular to the lift plate 54. Thus, the tiles on the lift plate are ascended to the tabletop and arranged in order.

The present invention further comprises a lid 44 disposed at an upper end of the push member or at an upper end of the tile passage. The lid 44 has a bottom surface. The tiles have a thickness. The distance between the bottom surface of the lid and the tiles is smaller than the thickness of the tiles. The bottom surface of the lid can be flat or oblique to ensure the topmost tile won't move upward. Preferably, the distance between the bottom surface of the lid and the tiles is from 1 mm to 2 mm, which is beneficial to achieve the aforesaid object. The size and shape of the lid can be changed and its installation is the prior art, just not interfering with the operation of the push member to push the tiles to the lift plate as well as the operation of the lift plate to ascend the tiles to the tabletop. The size of the lid is adapted to cover both the tile passage and the push member, or to cover the tile passage only, or to cover the middle portion of the tile passage. The shape of the lid can be sealed or hollow. The lid can be installed to the upper ends of both sides of the tile passage or disposed above the tile passage or the push member through support ribs.

Compared to the prior art, the present invention has a simple configuration and the tiles can be ascended quickly and won't be jammed. The failure rate is low.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A lift mechanism of a tiled-based game machine, installed on a table, the lift mechanism comprising a lift plate, one end of the lift plate being coupled to the table, another end of the lift plate being a movable end, a lift bracket provided under the lift plate, a crank provided under the lift bracket to cooperate with the lift bracket, and an electric motor connected with the crank, wherein one end of the crank is connected with the electric motor and another end of the crank is a movable end, the movable end of the crank being provided with a bearing, the lift bracket having a hook extending from a left side thereof to cooperate with the bearing, the crank is provided with an induction magnet and a lift control plate corresponds in position to the crank, the lift control plate being provided with an upper sensor and a lower sensor corresponding in position to the induction magnet of the crank when the lift plate is ascended and descended.

2. The lift mechanism as claimed in claim 1, wherein the movable end of the lift plate is provided with a door and the door is provided with a restoring spring.

3. The lift mechanism as claimed in claim 2, further comprising a push member, the push member having a contact surface at a certain angle, the contact surface of the push member being contact with tiles and perpendicular to the lift plate when the lift plate is descended to the lowest and the push member pushes the tiles to the lift plate, a lid disposed at an upper end of the push member, the lid having a bottom surface, the tiles each having a thickness, a distance defined between the bottom surface of the lid and the tiles being smaller than the thickness of the tiles.

4. The lift mechanism as claimed in claim 2, further comprising a push member, the push member having a contact surface at a certain angle, the contact surface of the push member being contact with tiles and perpendicular to the lift plate when the lift plate is descended to the lowest and the push member pushes the tiles to the lift plate, a lid disposed at an upper end of a tile passage, the lid having a bottom surface, the tiles each having a thickness, a distance defined between the bottom surface of the lid and the tiles being smaller than the thickness of the tiles.

5. The lift mechanism as claimed in claim 1, further comprising a push member, the push member having a contact surface at a certain angle, the contact surface of the push member being contact with tiles and perpendicular to the lift plate when the lift plate is descended to the lowest and the push member pushes the tiles to the lift plate, a lid disposed at an upper end of the push member, the lid having a bottom surface, the tiles each is having a thickness, a distance defined between the bottom surface of the lid and the tiles being smaller than the thickness of the tiles.

6. The lift mechanism as claimed in claim 1, further comprising a push member, the push member having a contact surface at a certain angle, the contact surface of the push member being contact with tiles and perpendicular to the lift plate when the lift plate is descended to the lowest and the push member pushes the tiles to the lift plate, a lid disposed at an upper end of a tile passage, the lid having a bottom surface, the tiles each having a thickness, a distance defined between the bottom surface of the lid and the tiles being smaller than the thickness of the tiles.

7. A lift mechanism of a tiled-based game machine, installed on a table, the lift mechanism comprising a lift plate, one end of the lift plate being coupled to the table, another end of the lift plate being a movable end, a lift bracket provided under the lift plate, a crank provided under the lift bracket to cooperate with the lift bracket, and an electric motor connected with the crank, further comprising a push member, the push member having a contact surface at a certain angle, the contact surface of the push member being contact with tiles and perpendicular to the lift plate when the lift plate is descended to the lowest and the push member pushes the tiles to the lift plate, further comprising a lid disposed at an upper end of the push member, the lid having a bottom surface, the tiles each having a thickness, a distance defined between the bottom surface of the lid and the tiles being smaller than the thickness of the tiles.

8. A lift mechanism of a tiled-based game machine, installed on a table, the lift mechanism comprising a lift plate, one end of the lift plate being coupled to the table, another end of the lift plate being a movable end, a lift bracket provided under the lift plate, a crank provided under the lift bracket to cooperate with the lift bracket, and an electric motor connected with the crank, wherein one end of the crank is connected with the electric motor and another end of the crank is a movable end, the movable end of the crank being provided with a bearing, the lift bracket having a hook extending from a left side thereof to cooperate with the bearing, further comprising a push member, the push member having a contact surface at a certain angle, the contact surface of the push member being contact with tiles and perpendicular to the lift plate when the lift plate is descended to the lowest and the push member pushes the tiles to the lift plate, further comprising a lid disposed at an upper end of the push member, the lid having a bottom surface, the tiles each having a thickness, a distance defined between the bottom surface of the lid and the tiles being smaller than the thickness of the tiles.

9. A lift mechanism of a tiled-based game machine, installed on a table, the lift mechanism comprising a lift plate, one end of the lift plate being coupled to the table, another end of the lift plate being a movable end, a lift bracket provided under the lift plate, a crank provided under the lift bracket to cooperate with the lift bracket, and an electric motor connected with the crank, further comprising a push member, the push member having a contact surface at a certain angle, the contact surface of the push member being contact with tiles and perpendicular to the lift plate when the lift plate is descended to the lowest and the push member pushes the tiles to the lift plate, a lid disposed at an upper end of a tile passage, the lid having a bottom surface, the tiles each having a thickness, a distance defined between the bottom surface of the lid and the tiles being smaller than the thickness of the tiles.

10. A lift mechanism of a tiled-based game machine, installed on a table, the lift mechanism comprising a lift plate, one end of the lift plate being coupled to the table, another end of the lift plate being a movable end, a lift bracket provided under the lift plate, a crank provided under the lift bracket to cooperate with the lift bracket, and an electric motor connected with the crank, wherein one end of the crank is connected with the electric motor and another end of the crank is a movable end, the movable end of the crank being provided with a bearing, the lift bracket having a hook extending from a left side thereof to cooperate with the bearing, further comprising a push member, the push member having a contact surface at a certain angle, the contact surface of the push member being contact with tiles and perpendicular to the lift plate when the lift plate is descended to the lowest and the push member pushes the tiles to the lift plate, a lid disposed at an upper end of a tile passage, the lid having a bottom surface, the tiles each having a thickness, a distance defined between the bottom surface of the lid and the tiles being smaller than the thickness of the tiles.

* * * * *